United States Patent [19]

Raikhlin

[11] Patent Number: 5,063,716

[45] Date of Patent: Nov. 12, 1991

[54] HOISTING APPARATUS

[76] Inventor: Mark M. Raikhlin, Volgo-gradsky prospekt, 9, kv. 89, Moscow, U.S.S.R.

[21] Appl. No.: 582,914

[22] PCT Filed: Feb. 17, 1989

[86] PCT No.: PCT/SU/89/0004

§ 371 Date: Oct. 15, 1990

§ 102(e) Date: Oct. 15, 1990

[87] PCT Pub. No.: WO90/09334

PCT Pub. Date: Aug. 23, 1990

[51] Int. Cl.[5] ..... E04H 12/18

[52] U.S. Cl. ..... 52/114; 52/167 R

[58] Field of Search ..... 52/111, 114, 116, 117, 52/121

[56] References Cited

U.S. PATENT DOCUMENTS

| | | | |
|---|---|---|---|
| 468,186 | 2/1892 | Beardsley | 52/167 R |
| 2,739,673 | 3/1956 | Foster | 52/111 |
| 3,954,157 | 5/1976 | Atkey . | |

FOREIGN PATENT DOCUMENTS

| | | |
|---|---|---|
| 417082 | 2/1981 | Sweden . |
| 1051025 | 10/1983 | U.S.S.R. . |
| 2053150 | 2/1981 | United Kingdom . |

*Primary Examiner*—David A. Scherbel
*Assistant Examiner*—Wynn Wood
*Attorney, Agent, or Firm*—Fleit, Jacobson, Cohn, Price, Holman & Stern

[57] ABSTRACT

The hoisting apparatus is comprised of a mast (1) consisting of four vertical rods (2, 2', 3,3') two of which have internal spaces accommodating strength members. The rods (3, 3') with strength members and other rods (2, 2') are arranged in pairs symmetrically to the vertical axis (5) of symmetry of the mast (1) and the cargo suspension (10) is, essentially, a rectangular frame enveloping the mast (1) and formed by two parallel beams (11, 11') each rigidly connected in its center with the corresponding bracket (9, 9'), and by two parallel rocker arms (12, 12') whose ends are articulated to the ends of the beams (11, 11').

1 Claim, 3 Drawing Sheets

HOISTING APPARATUS

TECHNICAL FIELD

The present invention relates to hoisting-and-conveying equipment and, more particularly, it relates to a hoisting apparatus.

BACKGROUND OF THE INVENTION

Known in the prior art is a hoisting apparatus realized in the form of a mast consisting of a vertical hollow rod secured in the base, the inside space of said rod accommodating strength members which are capable of moving along the rod. Said members are moved in two parallel rows—over the load carrying branch and the accumulating branch, the strength members being transferred from one branch to another by an operating mechanism installed in the rod base. The strength member nearest to the rod top supports a bracket connected to a cargo suspension (SU, A, 1051025).

The load capacity of the known apparatus is limited due to asymmetric application of load to the mast since the bracket carrying the cargo suspension and taking the load of the cargo moves over a guide located at one side of the rod, i.e. the load acts eccentrically relative to the vertical central axis of symmetry of the mast which restricts the load capacity of the apparatus.

There is another known cargo-hoisting apparatus in the form of a mast formed by four vertical rods interconnected by a lattice, two of said rods having spaces with strength members movably installed inside. One of strength members in each rod is connected with one of the cargo suspension brackets (SE, C, 417082). In this apparatus two rods with strength members are installed in one side plane of the mast while the two other rods, in the side surface of the mast which is parallel to the first surface; in this case the cargo suspension is, essentially, a beam whose ends are rigidly secured to the brackets and which has a cargo grip in the centre.

The hoisting apparatus is noted for a higher load capacity, since the load is distributed between two load-carrying branches in both rods with strength members. However, for reliable functioning of the known apparatus the strength members in the spaces of both rods should move in strict synchronism. If synchronism is disturbed, the cargo suspension may be cocked and jammed. Cocking of the cargo suspension also brings about heavy wear of parts at points where brackets interact with the strength members due to forces of friction. It should be noted that this hoisting apparatus is also characterized by asymmetrical effect of the load on the mast because the cargo suspension moves along one side of the mast so that the weight of the hoisted cargo acts eccentrically relative to the vertical central axis of symmetry of the mast.

SUMMARY OF THE INVENTION

The main object of the invention is to provide a hoisting apparatus with such a design of the mast and cargo suspension which would ensure application of load along the axis of symmetry of the mast during hoisting of the load, and uniform distribution of this load among all the rods of the mast and which would rule out the possibility of jamming of the moving cargo suspension even during asynchronous movement of the strength members in the rods.

This problem is solved by providing a hoisting apparatus in the form of a mast consisting of four vertical rods interconnected by a lattice, two of said rods having internal spaces accommodating strength members installed therein with a provision for moving along the rods, one of said members in each rod being connected with the corresponding bracket which, in turn, is fastened to the cargo suspension in which, according to the invention, two rods with strength members and two other rods are arranged in pairs symmetrically to the vertical axis symmetry of the mast and the cargo suspension is constituted by a rectangular frame fitting around the mast and formed by two parallel beams, rigidly connected, each, by its central part with the corresponding bracket, and by two parallel rocker arms whose ends are articulated to the ends of the beams.

In the hoisting apparatus realized according to the present invention the weight of the lifted cargo acts precisely along the central vertical axis of symmetry of the mast and is distributed uniformaly among all the four rods thus enabling the load capacity of the apparatus to be raised considerably without increasing the power of the drive and stiffness of construction. Asynchronous movement of the strength members in the mast rods only changes the inclination angle of the frame (cargo suspension) plane to the axis of symmetry of the mast while the load acting on the rods stays constant and depends on the weight of the cargo being hoisted. This precludes the possibility of cargo suspension jamming in case of asynchronous movement of strength members in the mast rods.

BRIEF DESCRIPTION OF THE DRAWINGS

Now the invention will be described by way of example with reference to the accompanying drawings, in which.

BEST MODE FOR CARRYING OUT THE INVENTION

Figure 1:
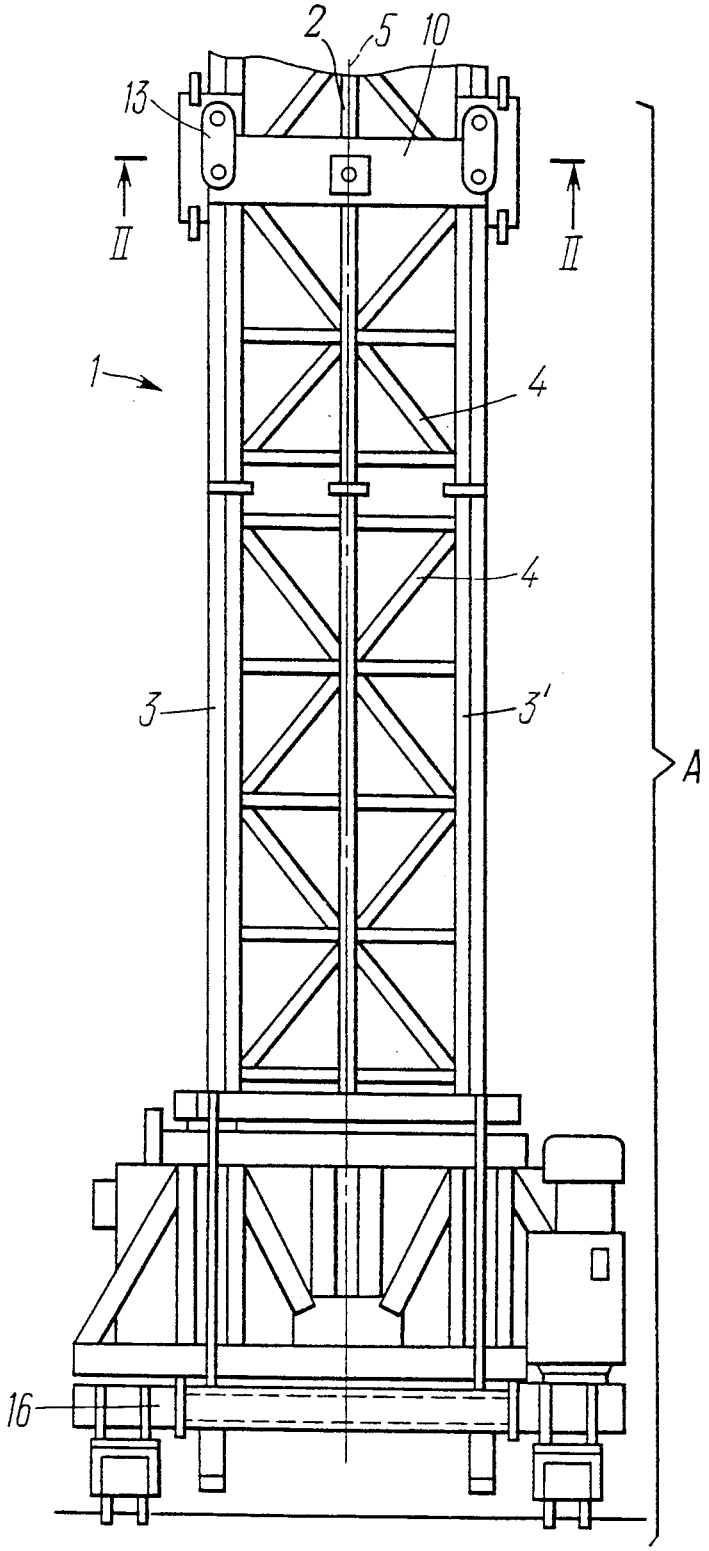
FIG. 1 is a general view of the hoisting apparatus according to the invention.
Figure 2:
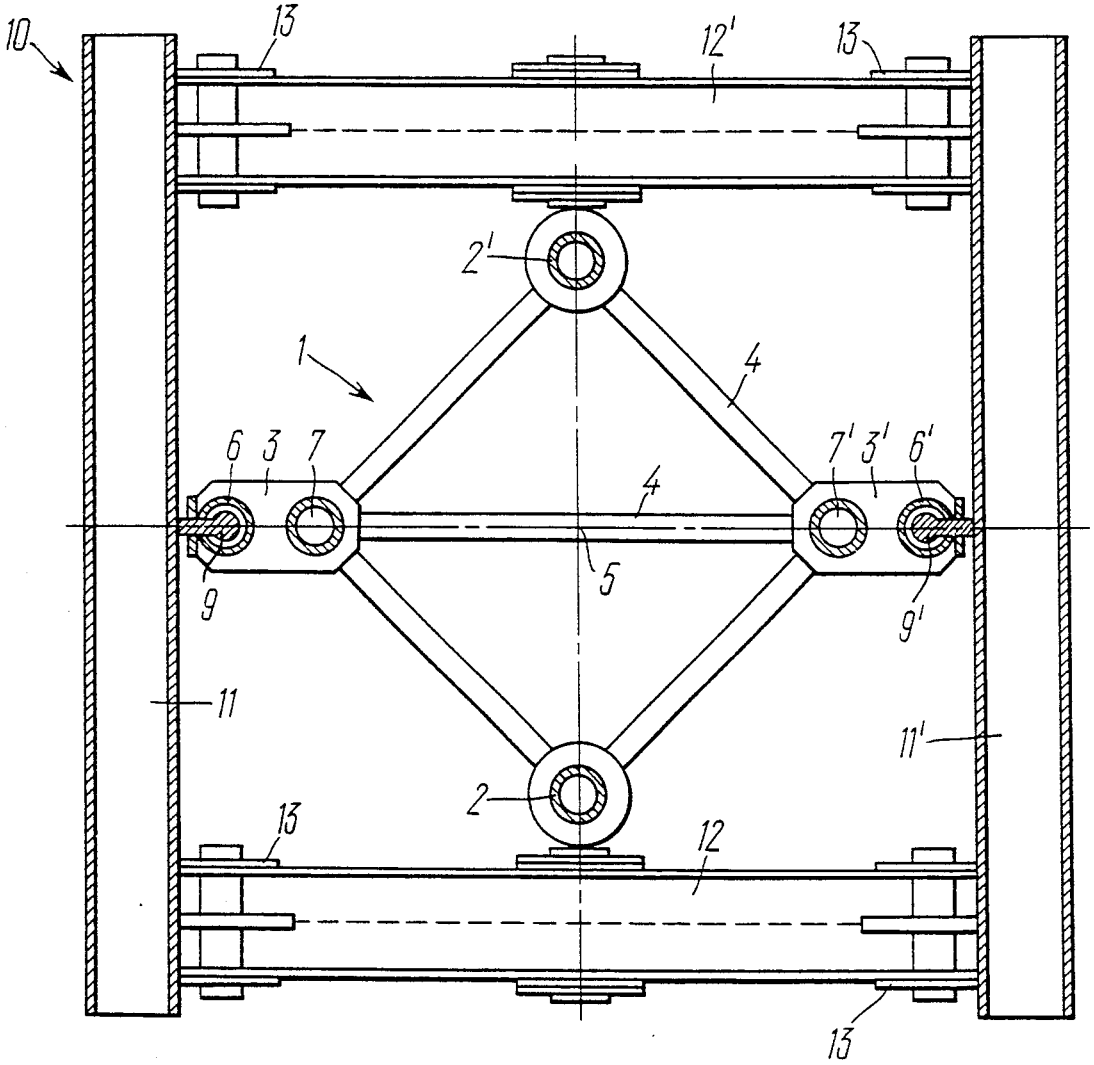
FIG. 2 is a section taken along line II—II in FIG. 1, enlarged.
Figure 3:
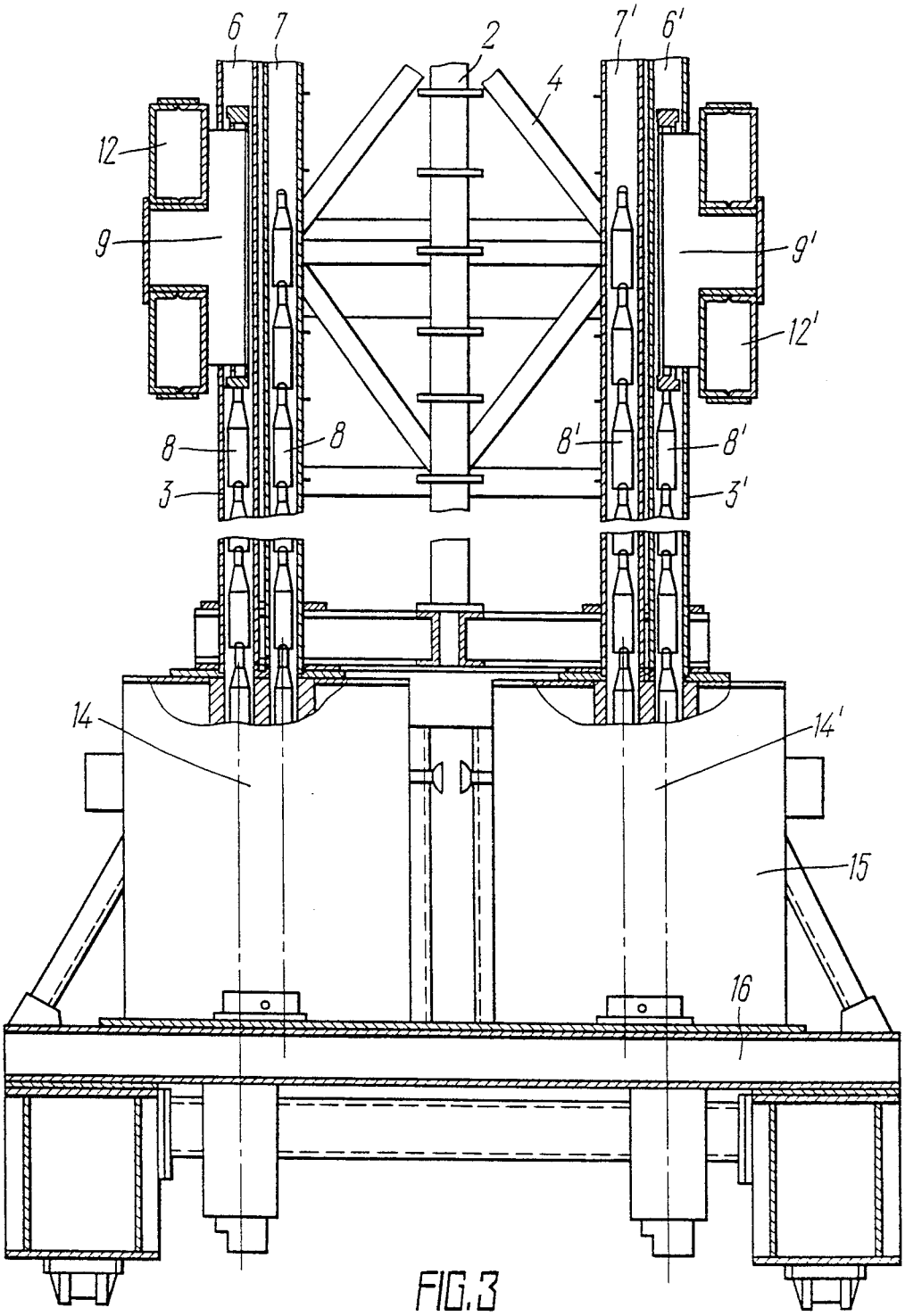
FIG. 3 is a fragment A in FIG. 1, partly cut away, enlarged.

The hoisting apparatus illustrated in FIGS. 1,2,3 comprises a mast 1 formed by four vertical rods 2,2' and 3,3'. The rods 2,2', 3,3' are interconnected by a lattice 4.

The rods 2,2' and 3,3' are arranged in pairs symmetrically to the central vertical axis 5 of symmetry of the mast 1. The rods 3 and 3' are hollow and the internal space of each rod has two load-carrying and accummulating branches 6,6' and 7,7' respectively. Accommodated in branches 6,6' and 7,7' are strength members 8,8' capable of reciprocating along the rods 3,3' and of moving from one branch, e.g. 6,6' into the other branch, e.g. 7,7'.

The strength members 8,8' hearest to the top of the mast 1, located in the load-carrying branches 6,6' are connected with brackets 9,9' which, in turn, are fastened to the cargo suspension 10.

The cargo suspension 10 is a rectangular frame enveloping the mast 1 over the perimeter. The frame 10 is formed by two parallel beams 11,11', each rigidly connected in its central part with the corresponding bracket 9,9', and by two parallel rocker arms 12 and 12' whose ends are articulated by shackles 13 to the ends of the beams 11,11'.

The mechanism 14,14' for operating the strength members 8,8' is located in the lower part of the mast 1 under each of the rods 3 and 3'. Each mechanism 14,14' has a drive, (e.g. hydraulic) of its own (not shown in the drawing). The strength member operating mechanisms 14,14' transfer the strength members 8 and 8' from the accumulating branches 7 and 7' into the load-carrying branches 6 and 6', and back.

The mechanism 14 and 14' are housed in a common casing 15 on which the mast 1 is installed.

In addition, the casing 15 with the mast 1 is mounted on a transport vehicle 16, though it may be installed in a stationary way too.

the hoisting apparatus functions as follows.

As the operating mechanisms 14 and 14' are switched on for lifting motion the strength members 8 and 8' start moving from the accumulating branches 7 and 7' into load-carrying branches 6 and 6'; the branckets 9 and 9'0 connected with the strength members 8,8' nearest to the top of the mast 1 start moving upward along the load-carrying branches 6 and 6' and, consequently, the cargo suspension 10 with the attached cargo (not shown in the drawing) starts going up along the mast 1.

Inasmuch as the operating mechanisms 14,14' cannot work in absolute synchronism, the brackets 9 and 9' may move out of synchronism, i.e. the bracket 9, for example, may lag behind the bracket 9'; hence, the beams 11 and 11' of the cargo suspension 10 rigidly connected with said brackets will also move out of synchronism.

The resultant cocking of the rocker arms 12,12' articulated with beams 11,11' does not impose additional loads on the rods 3 and, consequently, on the entire structure of the mast 1 because the arm of the force of the handled load applied to the rods 3 and 3' stays unchanged in spite of cocking of the rocker arms 12 and 12'.

Besides, due to symmetrical arrangement of rods 3 and 3' relative to the central axis 5 of symmetry of the mast 1, said rods functioning as guides for the moving suspension 10, the forces arising in the mast 1 under the weight of the hoisted cargo are distributed symmetrically relative to the vertical axis 5 of the mast 1 among all the rods 2,2' and 3,3' which rules out probable bending moments in the mast 1 which, in turn, permits reducing its mass at the same load capacity.

In case of a very heavy cargo the provision of two guides, i.e. two rods with strength members and two operating mechanisms, permits dispensing with the drive of a high unit power which also contributes to reducing the cost of the hoisting apparatus according to the invention.

INDUSTRIAL APPLICABILITY

The hoisting apparatus can be employed in construction and erection work, when building industrial and public service, objects, engineering structures, installation of technological equipment also in reconstruction and major rebuilding of industrial objects.

I claim:

1. A hoisting apparatus in the form of a mast (1) consisting of four vertical rods (2,2', 3,3') interconnected by a lattice (4) two of said rods having internal spaces accommodating strength members (8,8') capable of moving along the rods (3,3'), one of said members in each rod (3,3') being connected with the corresponding brackets (9,9') which, in turn, are fastened to the cargo suspension (10) characterized in that the rods (3,3') with the strength members (8,8') and the rods (2,2') are arranged in pairs, symmetrically to the vertical axis (5) of symmetry of the mast (1) and the cargo suspension (10) is, essentially, a rectangular frame enveloping the mast (1) and formed by two parallel beams (11,11'), each rigidly connected in its center with the corresponding bracket (9,9'), and by two parallel rocker arms (12,12') whose ends are articulated to the ends of the beams (11,11').

* * * * *